US009539493B2

(12) United States Patent
Shideler et al.

(10) Patent No.: US 9,539,493 B2
(45) Date of Patent: Jan. 10, 2017

(54) STORY BASED CARD GAME

(76) Inventors: Lauren Emily Shideler, Gibsonia, PA (US); Blynn L. Shideler, Gibsonia, PA (US)

( * ) Notice: Subject to any disclaimer, the term of this patent is extended or adjusted under 35 U.S.C. 154(b) by 1216 days.

(21) Appl. No.: 11/779,876

(22) Filed: Jul. 18, 2007

(65) Prior Publication Data

US 2008/0012228 A1 Jan. 17, 2008

Related U.S. Application Data

(63) Continuation-in-part of application No. 11/082,181, filed on Mar. 16, 2005, now abandoned, which is a continuation-in-part of application No. 10/730,586, filed on Dec. 8, 2003, now abandoned, which is a continuation of application No. 10/189,354, filed on Jul. 3, 2002, now Pat. No. 6,659,463, which is a continuation-in-part of application No. 09/479,531, filed on Jan. 7, 2000, now Pat. No. 6,857,633.

(60) Provisional application No. 60/115,162, filed on Jan. 8, 1999, provisional application No. 60/553,663, filed on Mar. 16, 2004.

(51) Int. Cl.

| | |
|---|---|
| ***A63F 1/00*** | (2006.01) |
| ***A63F 1/04*** | (2006.01) |
| *A63F 3/00* | (2006.01) |

(52) U.S. Cl.

CPC ..... *A63F 1/04* (2013.01); *A63F 3/00075* (2013.01); *A63F 2001/0441* (2013.01); *A63F 2001/0483* (2013.01)

(58) Field of Classification Search

CPC ..... A63F 1/00
USPC ..... 273/292
See application file for complete search history.

(56) References Cited

U.S. PATENT DOCUMENTS

| | | | | |
|---|---|---|---|---|
| 1,716,069 | A * | 6/1929 | Loayza | 273/141 R |
| 5,435,726 | A * | 7/1995 | Taylor | 434/128 |
| 5,540,609 | A * | 7/1996 | Hoag | 446/26 |
| 6,638,171 | B1 * | 10/2003 | Igarashi et al. | 463/43 |
| 7,320,467 | B2 * | 1/2008 | Matilla et al. | 273/292 |
| 2002/0074727 | A1 * | 6/2002 | Glaser | 273/429 |
| 2004/0178577 | A1 * | 9/2004 | Kline et al. | 273/236 |
| 2005/0001377 | A1 * | 1/2005 | Bradley | 273/292 |
| 2005/0093239 | A1 * | 5/2005 | Johnston | 273/273 |
| 2005/0167920 | A1 * | 8/2005 | Rose et al. | 273/292 |

* cited by examiner

*Primary Examiner* — Gene Kim
*Assistant Examiner* — Dolores Collins
(74) *Attorney, Agent, or Firm* — Blynn L. Shideler; Krisanne Shideler; BLK Law Group

(57) ABSTRACT

A story based card game has a series of sequential rounds, the card game comprising a plurality of sets of location cards, one set of location cards for each of a plurality of locations associated with an aspect of the story, each set of location cards including one card for each round of the game, wherein each round includes at least one correct location card for that round, wherein the correct location card for each round includes text indicating that the it is the correct card for that round and including a continuation of the story, whereby the series of correct locations cards for the rounds of the game combine to form a story summary.

9 Claims, 4 Drawing Sheets

Figure 3A
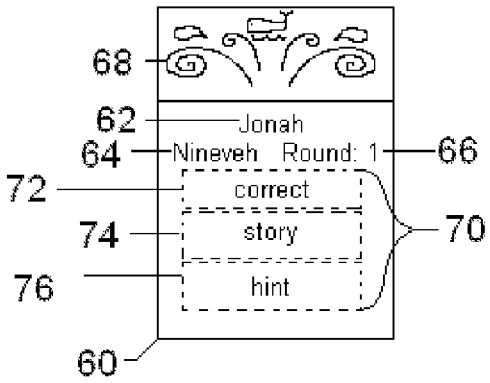
Figure 3B
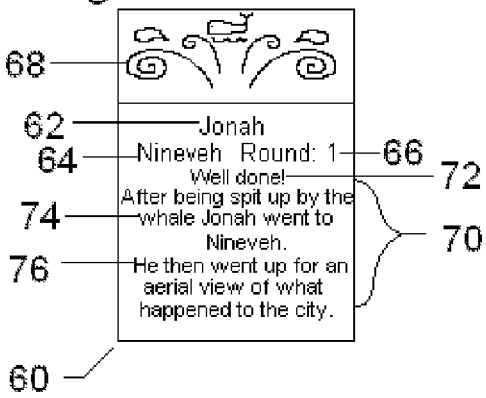
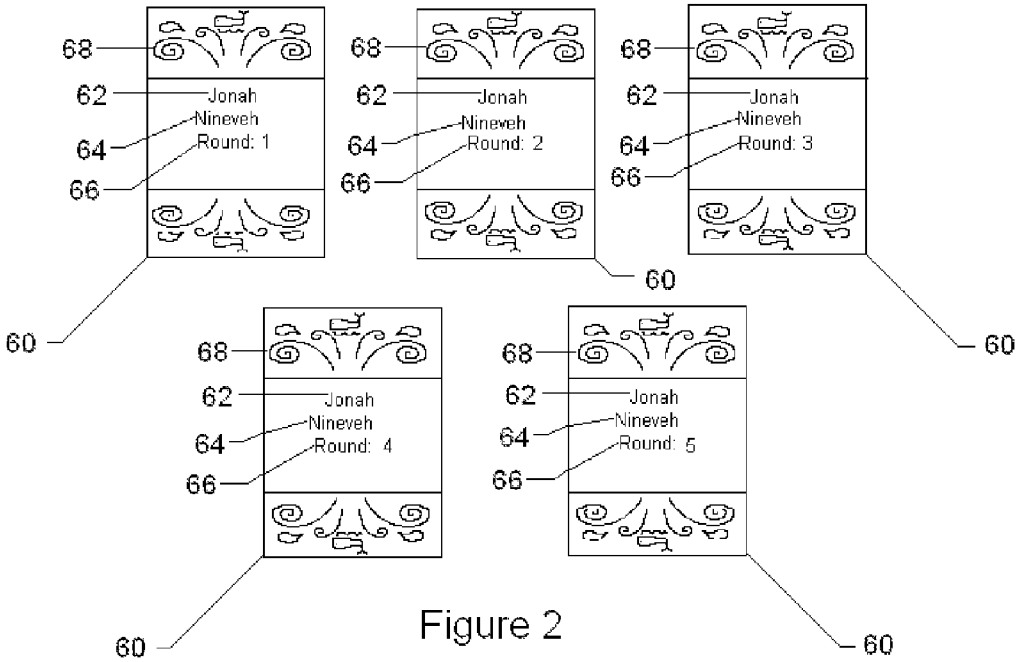
Figure 2

STORY BASED CARD GAME

CROSS REFERENCE TO RELATED APPLICATIONS

This application is a continuation-in-part of U.S. patent application Ser. No. 11/082,181 entitled "Gaming Equipments and Methods" filed on Mar. 16, 2005. U.S. patent application Ser. No. 11/082,181 is now abandoned and published Sep. 1, 2005 as U.S. Publication No. 2005/0189715. U.S. patent application Ser. No. 11/082,181 is a continuation-in-part of U.S. patent application Ser. No. 10/730,586 entitled "Miniature Toy Gaming Equipment". U.S. patent application Ser. No. 10/730,586, now abandoned, published Jun. 24, 2004 as publication number 2004/0119234. U.S. patent application Ser. No. 10/730,586 is a continuation of U.S. patent application Ser. No. 10/189,354 entitled "Castle Blocks Board Game" filed Jul. 3, 2002, now U.S. Pat. No. 6,659,463, entitled "Interconnecting Miniature Toy Figurine Bases". U.S. patent application Ser. No. 10/189,354 published May 8, 2003 as publication number 2003/0085517 and is a continuation-in-part of U.S. patent application Ser. No. 09/479,531 filed Jan. 7, 2000, now U.S. Pat. No. 6,857,633 entitled "Castle Blocks Board Game". U.S. patent application Ser. No. 09/479,531 claims the benefit of U.S. provisional patent application Ser. No. 60/115,162, filed Jan. 8, 1999, and entitled "Castle Blocks Board Game". U.S. patent application Ser. No. 11/082,181 further claims the benefit of U.S. provisional patent application Ser. No. 60/553,663, filed Mar. 16, 2004, entitled "Gaming Equipment and Method." These published patent applications and issued patents are incorporated herein by reference in their entirety.

BACKGROUND OF THE INVENTION

1. Field of the Invention

The present invention relates to games and, more particularly, to storyline based card games.

2. Background Information

Board games challenge the mind and teach players various skills and concepts, such as formulating strategies, sharing, socializing, competing, winning, and losing. Board games represent a class of activities that encourage cognitive mental development by challenging player's minds, as opposed to their bodies.

Card based games, whether played on an associated board or not, generally incur inexpensive manufacturing costs and offer correspondingly inexpensive games to the consumers. A Card based game is any game using playing cards, either traditional (e.g. poker, or rummy) or game-specific (e.g. Magic the Gathering). A playing card is a typically hand-sized piece of heavy paper or thin plastic. A complete set of cards is a pack or deck. A deck of cards is used for playing one or many card games.

The earliest playing cards are believed to have originated in Central Asia. The documented history of card playing began in the 10th century, when the Chinese began using paper dominoes by shuffling and dealing them in new games. Four-suited decks with court cards evolved in the Moslem world and were imported by Europeans before 1370. In those days, cards were hand-painted and only the very wealthy could afford them, but with the invention of woodcuts in the 14th century, Europeans began mass-production.

Collectible card games (CCGs), also called trading card games (TCGs), are played using specially designed sets of playing cards. While trading cards have been around for much longer, CCGs combine the appeal of collecting and strategic game play. The first collectible card game was The Base Ball Card Game produced by The Allegheny Card Co. at the turn of the 19$^{th}$ century. The modern concept of CCG games was first presented in Magic: The Gathering™, designed by Richard Garfield and published by Wizards of the Coast in 1993.

Background storylines are often used to establish a setting in which a strategy card game is played. One card game has used cards to convey or build a series of storylines, namely Nanofictionary™ is a card game created by Andrew Looney and published by Looney labs in which players collect cards and use them to make up stories. At the beginning of the game, the players are dealt various cards that represent story elements (characters, settings, situations, and resolutions.) Players then all take a turn at once, exchanging these cards for new ones or collecting more of them if desired. After every player has accumulated a full story's worth of cards, each creates a short story based on the cards they ended up with and the group then votes on who has the best story. This process may be repeated.

Trivial Pursuit™ is a board game where progress is determined by a player's ability to answer general knowledge or popular culture questions. The game was conceived in 1979 by Scott Abbott and Chris Haney. The questions asked are provided in unique card sets that make up the essence of the game. A large number of distinct question sets have been produced over the years since its introduction, generally specializing in a given field.

Clue™ is a crime fiction board game originally published by Waddingtons beginning in 1948. It was devised by Anthony E. Pratt, and is now published by Hasbro. The game is set in a mansion, with the board divided into different rooms. The players each represent a character who is a guest staying at this house, whose owner, Mr. Boddy (Dr. Black in some versions), has been found murdered. Players attempt to solve the murder. The solution to the murder requires the three components of Suspect, Weapon, and Room. With all of the suspects, weapons and rooms being represented in a single game deck of cards.

Games in general have long been used by educators to assist student in learning by increasing the enjoyment in the material presentation or review.

The always remains a need for educational games, and for interesting games in general.

SUMMARY OF THE INVENTION

The present invention is directed toward a story based card game having a series of sequential rounds, the card game comprising a plurality of sets of location cards, one set of location cards for each of a plurality of locations associated with an aspect of the story, each set of location cards including one card for each round of the game, wherein each round includes at least one correct location card for that round, wherein the correct location card for each round includes text indicating that the it is the correct card for that round and including a continuation of the story, whereby the series of correct locations cards for the rounds of the game combine to form a story summary.

These and other advantages of the present invention will be clarified in the Brief Description of the Preferred Embodiments taken together with the attached drawings in which like reference numerals represent like elements throughout.

BRIEF DESCRIPTION OF THE DRAWINGS

FIG. 2 is a schematic view of a proposed set of location cards for a story based card/board game according to the present invention;

FIG. 3*a* is a schematic view of a generic correct location card for a story based card/board game according to the present invention;

FIG. 3*b* is a schematic view of a sample correct location card for a story based card/board game according to the present invention;

DESCRIPTION OF THE PREFERRED EMBODIMENTS

Figure 1:
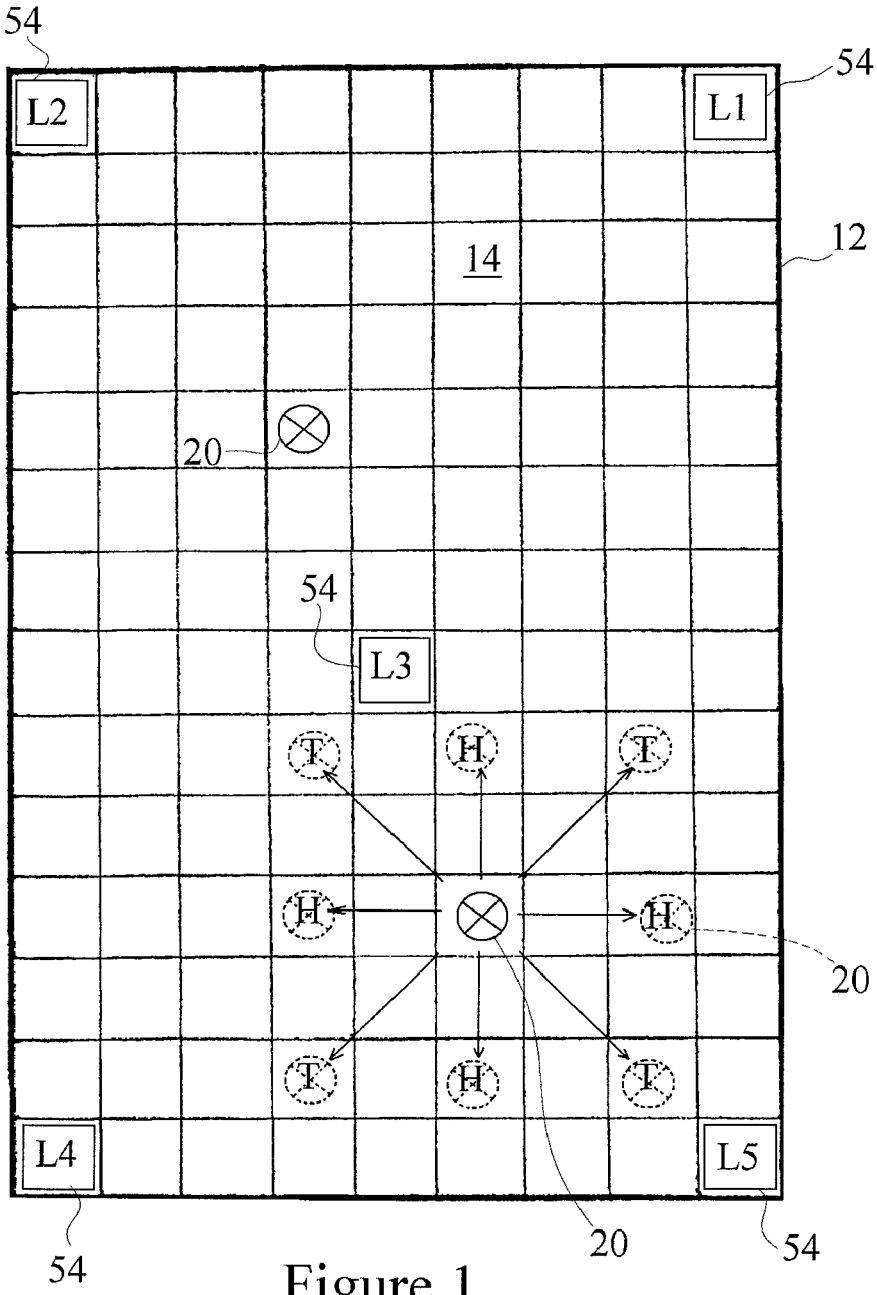
FIG. 1 is a schematic plan view of a story based card/board game according to one embodiment of the present invention.

Inventors Thomas J. Mackey and Blynn L. Shideler developed a rapid game mapping system for conveying the game environment to the players of a game and this development is disclosed in U.S. Publication No. 2005/0189715, which is incorporated herein by reference as noted above. An adventure game, such as a role playing game (e.g. Dungeons and Dragons™), in a simulated dungeon environment uses the mapping system described therein and no further discussion of this invention is required hereinafter.

Inventors Thomas J. Mackey and Blynn L. Shideler developed a gaming system embodied within a game entitled "Thunder Lords of DaGOOM" and that incorporates many of the character details of a roll playing game yet has no need for a dedicated game master. Thunder Lords is intended to seamlessly blend the high level of character detail commonly found in a roll playing game into an easily mastered miniature war game. Thunder Lords provides a high level of combat detail in a fast moving game. Characters are developed by the player (The Thunder Lord) to have basic attributes associated with his physical characteristics. In addition, characters are equipped with weapons and armor, either through purchase or as the spoils of war. Finally, characters are developed by the player to have combat skills acquired through initial training and enhanced through victorious combat experience. There is a realistic interrelationship among the character attributes. The result is to create vivid personas for each individual heroic adventurer. This invention is disclosed in U.S. Publication No. 2005/0189715, which is incorporated herein by reference as noted above and no further discussion of this invention is required hereinafter.

The inventors Lauren Emily Shideler and Blynn L. Shideler developed the story based game platform of the present claimed invention which is set forth herein in detail.

FIGS. 1-6 represent a game system according to the present invention. This is essentially a card based game platform that can be used to review a book or other preset storyline, or to play through unique storylines, e.g. the players can solve a mystery without having prior knowledge of the story.

The present invention may be considered a board game in that it is implemented on a board type play surface 12. The play surface 12 can have grids 14 as described in disclosed in U.S. Publication No. 2005/0189715, which is incorporated herein by reference as noted above. Of course the play surface 12 may be provided with the remaining game components as is conventional in the board game art. However, as the board or play surface 12 is generic, it need not be provided with the other components of the game. It is anticipated that the game components may be provided to the consumers as a deck of cards associated with a given story as detailed below and it may include everything except the play surface 12. The players can utilize a previously obtained surface 12 or can easily create one. For example in a classroom setting the grid 12 can be easily drawn on a blackboard.

The game system includes the use of a plurality of player tokens 20 with each token 20 representative of a player in the game. Each token 20 may be sized to be received within a grid 14 on the floor 12, and to be moved on the grid work 14 of the floor 12. The tokens 20 may take many conventional forms such as a non-descript graspable member (e.g. a Parcheesi game piece, or a pawn in a standard chess set), an image on a flat panel (e.g. a card or portion thereof), a miniature figurine, such as sold by Reaper® miniatures, or the like as known in the art.

The game includes a plurality of location tokens 54 that are intended to be placed on the grids 14 of the playing surface 12. The size of the playing surface 12 is not critical, and there is some advantage to a small board as it may not be immediately apparent to other players where a given player is headed on a small board. The location tokens 54 are associated with the storyline and generally represent physical locations of the storyline (e.g. The Apartment Building, the University, the Library, the Cemetery, and the Jail). The location tokens 54 can also represent states or actions associated with the story, such as "Prayer" and "Turning from God" in a Biblical story, or "War", "Depression", "Isolationism" in nation's historical narrative.

The Location tokens 54 may be randomly placed on the playing surface 12, or set in predefined locations, such as one in each corner to use the entire playing surface 12.

Play begins with reading of a prologue card which will identify a starting location token 54 and set forth the beginning of the story. The prologue card will typically also have a hint as to which is the next location in the sequence (the desired location for round one). The location tokens 54 may be cards as well, or punch-outs of a card.

How clear or easy the hint on the Prologue card is depends, of course, on the intended audience for the game.

The players then move their respective player tokens, in turn, to what they individually believe is the next correct location token 54 in the sequence of the story. In other words the players move towards where they believe the hint from the prologue or prior round card is taking them.

The particular movement rules can vary, however an effective system is that movement of a player token 20 is one or two spaces, at the player's option, in a defined direction such as diagonal direction or along the rows and columns of the grid 14. A flip of a coin will determine whether the player moves diagonally or along the rows and columns (e.g.

Tails—Diagonal movement; head—Rows and columns). This movement method is intended to add some randomizing elements into the game without the need to provide players with separate randomizing movement device. Alternatively a set of dice, or a spinner could be used to define movement. The amount of the movement can be changed depending upon the size of the board or playing surface 12.

There is one location card 60 for each location and for each round (or level) of the game, so if "Jail" is a location then there is a Jail round 1 card, a Jail round 2 card, etc. through the last round. FIG. 2 illustrates the back or common side of a set of location cards 60 for the location "Nineveh" associated with the Biblical story of Jonah. As shown each card 60 has title indicia 62, "Jonah" in the example, which is representative of the associated story that forms the subject of the game. Each card 60 further includes location indicia 64 and round indicia 66 associated with the card 60. Further it is expected that the card 60 includes appropriately themed artwork 68 on or throughout the card 60.

When a player has his token 20 land on a location token 54, he may examine the location card 60 for the round that the player is in and must announce the location and the round to the other players (such as "I am looking at the Round 3 JAIL Card" or "I am examining the Nineveh Round 1 card"—such that all players can track their own locations and that of other players). All players begin in round 1. Players do not advance to the second round until they have reached the relevant round 1 location, or the round 1 goal. Players may not be required to announce when they have advanced a round UNTIL they elect to view location card for the next higher round. The second and third rounds are played the same. Thus if another player announces that he is looking at the round three JAIL card 60 then a review of that players prior card inspections would give hints as to the proper location for rounds 1 and 2.

FIG. 3*a* is a schematic view of the front side of a generic correct location card 60 for a story based card/board game according to the present invention, and FIG. 3*b* is a schematic view of a sample of a front side of a correct location card 60 for a story based card/board game according to the present invention. As shown the front side of the correct card 60 will generally include title indicia 62, location indicia 64, round indicia 66 and appropriately themed artwork 68 as noted above. The card 60 will also include text 70 that will indicate that the card is the correct location in portion 72, will also have text in portion 74 that continues with the desired storyline and a hint in portion 76 as to the next round target location (unless it is the last round and then it announces the player as the winner or that it is the end of the game).

Figure 4A:
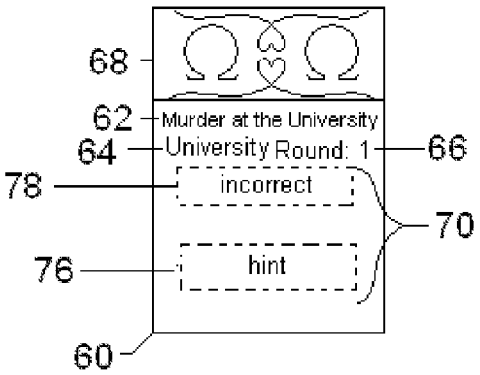
FIG. 4*a* is a schematic view of a generic incorrect location card for a story based card/board game according to the present invention.
Figure 4B:
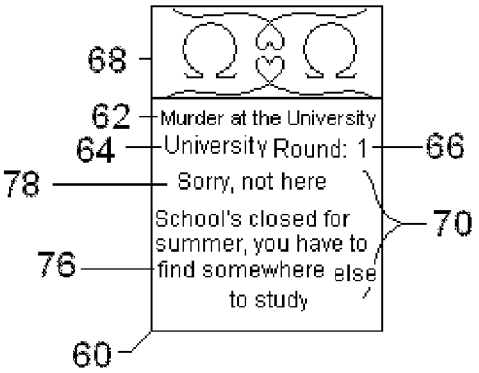
FIG. 4*b* is a schematic view of a sample incorrect location card for a story based card/board game according to the present invention.

FIG. 4*a* is a schematic view of the front side of a generic incorrect location card 60 for a story based card/board game according to the present invention, and FIG. 4*b* is a schematic view of a sample of a front side of an incorrect location card 60 for a story based card/board game according to the present invention. As shown the front side of the incorrect card 60 will generally include title indicia 62, location indicia 64, round indicia 66 and appropriately themed artwork 68 as noted above. The card 60 will also include text 70 that will indicate that the card is the incorrect location in portion 78, and will also have a hint in portion 76 as to the next round target location. As shown in the figures as a representative example the University for round 2 may say "Wrong location, school closed for summer break—try studying for next term" when the correct location for that round is the library location.

The goal of the game is to find all the desired locations for each round completing the story. The first player to compete the story wins. When a player wins the game, the player must identify or announce the location goals for each round, and read these cards to the other players, in order. If he is incorrect then he is disqualified and play continues with the remaining players. There is no limit to the number of rounds, no requirement that all of the locations be used as a target location for any round or that the same location may not be the target location for successive rounds.

Figure 6A:
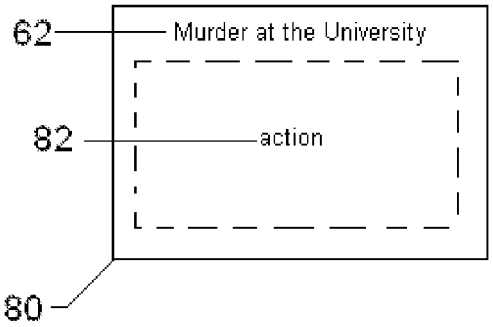
FIG. 6*a* is a schematic view of a generic action card for a story based card/board game according to the present invention.
Figure 6B:
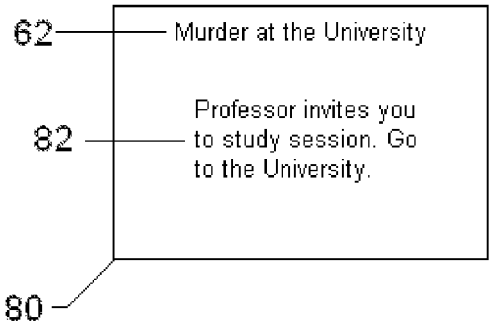
FIG. 6*b* is a schematic view of a sample action card for a story based card/board game according to the present invention.
Figure 5:
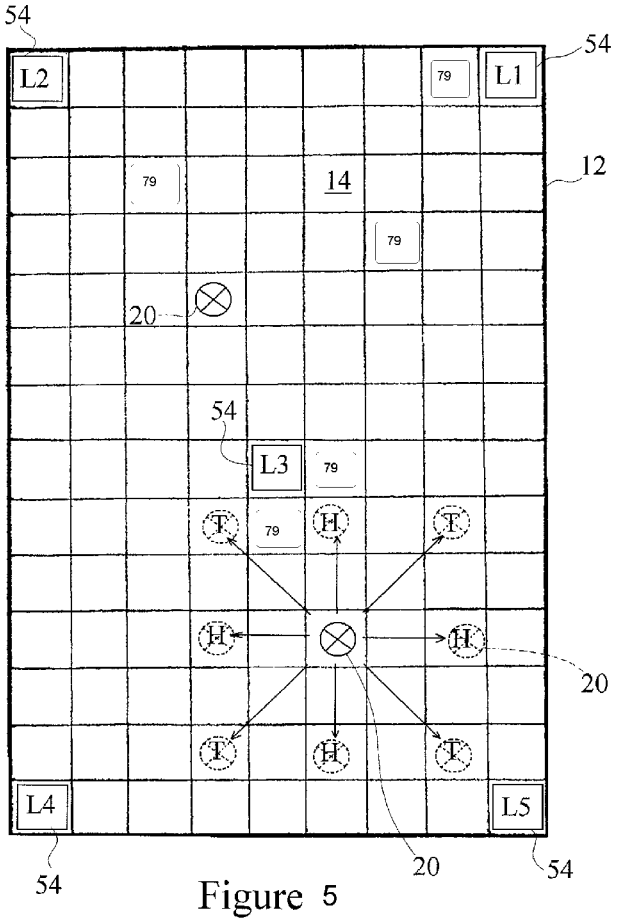
FIG. 5 is a schematic plan view of a story based card/board game according to a modified embodiment of the present invention.

FIG. 5 is a schematic plan view of a story based card/board game according to a modified embodiment of the present invention. In this modified version of the game action tokens 79 can be placed selectively or randomly upon the board 12. When a player lands on the action tokens 78 an action card 80 is selected and the player will do what is described on the card. FIG. 6*a* is a schematic view of a generic action card 80 for a story based card/board game according to the present invention; and FIG. 6*b* is a schematic view of a sample action card 80 for a story based card/board game according to the present invention. As shown the card 80 will generally include title indicia 62 and will also include text 82 that will indicate what action the player is to take. The action card 80 allows for an additional amount of variation to be incorporated into the game as will be appreciated by those of ordinary skill in the art. It would be expected that some cards 80 will assist the player while others will inhibit the player's progress. It is expected that certain cards will help and hurt the player's progress depending upon what round the action card is selected in.

The advantage of the game is that it is essentially a card based game. The board 12 is not critically important for the distribution of the game. The cards for a game, once played are not likely to be played again by the same players, which is one of the marketing points of the game. Although teachers may keep them for use by subsequent years' students. It is believed that the present invention makes a particularly effective teaching aid. The game cards may be sold with replacement packs for subsequent games, and because they are merely cards, a new game, or package of multiple games, can be relatively inexpensive.

The game can be made has hard or as easy as desired based upon the rounds, number of locations, and the hints (or misdirections) given. The cards, when done in the correct order effectively tell a story and can therefore be used as a review of a given story, or to introduce classics to children. They can be used to review history or biographies. The game is well suited for the mystery genre. The game is easily adapted to display distinct genres, for example the locations 54 may be islands and the tokens 12 a ship.

The invention has therefore been described with reference to the preferred embodiments. Obvious modifications and alterations will occur to others upon reading and understanding the preceding detailed description. It is intended that the invention be construed as including all such modifications and alterations insofar as they come within the scope of the appended claims or the equivalents thereof.

What is claimed is:

1. A method of playing a story based card game associated with a predetermined story and having a series of locations associated with the predetermined story and wherein the game includes a preset number of sequential rounds, the card game comprising: a plurality of sets of location cards, one set of location cards for each of the plurality of locations associated with an aspect of the predetermined story, each set of location cards including one card for each round of the game, wherein each round includes at least one correct location card for that round, wherein each correct location card for each round includes indicia indicating that it is the correct card for that round and including a continuation of the story, whereby a series of correct locations cards for the rounds of the game combine to form a story summary, the method comprising the steps of having the players selectively choose a location card for each round and having the players repeat the selection process until one player can identify all of the correct location cards in the series of correct location cards.

2. The method of playing a story based card game according to claim 1 wherein each location card includes title indicia which is representative of the associated story, location indicia and round indicia.

3. The method of playing a story based card game according to claim 2 wherein each location card includes themed artwork on the card.

4. The method of playing a story based card game according to claim 2 wherein each location card except for each correct location card of the final round includes text including one of a hint regarding the next sequential correct location card.

5. The method of playing a story based card game according to claim 2 further including a game board divided into separate playing spaces.

6. The method of playing a story based card game according to claim 5 further including player tokens movable on the game board.

7. The method of playing a story based card game according to claim 6 further including location tokens positioned on the game board.

8. The method of playing a story based card game according to claim 7 wherein the location tokens are formed of cards.

9. The method of playing a story based card game according to claim 4 wherein the text of each location card includes a portion indicating whether the card is a correct location card or an incorrect location card.

* * * * *